United States Patent [19]

Scheid

[11] 4,112,647

[45] Sep. 12, 1978

[54] MOVABLE PARTITION WALL SYSTEM

[76] Inventor: Lloyd J. Scheid, 4404 Grimes Pl., Encino, Calif. 91316

[21] Appl. No.: 792,873

[22] Filed: May 2, 1977

[51] Int. Cl.[2] ..... E04B 2/30

[52] U.S. Cl. ..... 52/481; 52/243; 52/281; 52/586

[58] Field of Search ..... 52/481, 243, 259, 281, 52/586, 584, 344, 347, 351, 353, 355, 489, 359

[56] References Cited

U.S. PATENT DOCUMENTS

| | | | |
|---|---|---|---|
| 1,110,708 | 9/1914 | Malarkey | 52/353 |
| 1,873,292 | 8/1932 | Collins | 52/489 |
| 2,066,006 | 12/1936 | Kellogg | 52/489 |
| 2,456,049 | 12/1948 | Carrozza | 52/281 |
| 2,851,740 | 9/1958 | Baker | 52/489 |
| 3,017,673 | 1/1962 | Biris | 52/359 |
| 3,401,494 | 9/1968 | Anderson | 52/351 |
| 3,533,205 | 10/1970 | Pestel | 52/481 |

FOREIGN PATENT DOCUMENTS

| | | | |
|---|---|---|---|
| 2,120,449 | 12/1971 | Fed. Rep. of Germany | 52/586 |

*Primary Examiner*—Ernest R. Purser
*Assistant Examiner*—Henry Raduazo
*Attorney, Agent, or Firm*—Mahoney, Schick & Cislo

[57] ABSTRACT

A movable partition construction which employs a unique overlap joint feature and means for erecting the individual panels in place to obtain a movable partition which has at least a one hour fire rating to thereby provide fire resistive partition wall construction, which is easily erectable and thereafter demountable should the partitioning or removal be desired. The panels are prefabricated on the factory site with a variety of exterior surfaces and are shipped to the building or job site where they are easily positionable into partition wall-forming members permitting the erection of partition walls in relatively short periods of time compared to existing prior art expedients. The resultant wall is fire-resistive and aesthetic in appearance.

20 Claims, 10 Drawing Figures

MOVABLE PARTITION WALL SYSTEM

BACKGROUND OF THE INVENTION

On-site, erectable, building partition walls are known in the prior art and the invention of this application is directed to a unique design and structure for movable partition wall systems. The invention employes panel members and modes of erection resulting in partitions of fire-resistive construction which the prior art, as far as is known, has not been able to achieve.

The prior art, movable, partition walls have utilized various expedients to retain individual partitions in position such as hooks and corresponding or accommodating slots in order to receive the hooks. Additionally, known demountable partition systems, due to the elements of construction, have entailed a considerable amount of time in erecting the wall members, all of which have added to the cost of erecting a movable partition system. In each prior art instance, as far as is known, the resultant partition wall has not been of the quality to resist attack thereon by the ravages of fire and the like and generally have been unable to merit a fire rating that would qualify as a one hour fire-resistive wall structure.

With the herein disclosed invention, because of the unique design of the individual panels making up the system, and because of the joint formed by the individual panels, as well as the means of securing and mounting the individual panels to form a partition wall, all of the shortcomings of the prior art are alleviated and because of the unique design of the wall system, a partition wall is erectable in many instances, in less than one-fifth of the time required for conventional prior art, partition wall systems. Another attribute of the wall system of the invention is the fact that various exterior wall finishes are already provided at the factory site, thereby obviating the need for exterior wall finishing of an extensive nature on the building site.

OBJECTS AND SUMMARY OF THE INVENTION

It is an object of the invention to provide a demountable partition system.

It is another object of the invention to provide a movable wall partition system employing a unique and novel means of erecting individual panels thereof.

It is another important object of the invention to provide a movable wall partition system which has at least a one hour fire-resistive classification.

It is another important, more specific object of the invention to provide a movable wall partition system which is easily erectable into the finished state.

It is another still more important specific object of the invention to provide wall panels for utilization in the construction of a partition system employing a uniquely configured joint between panel members.

It is still another more specific object of the invention to provide a partition wall system utilizing unique means of securing individual panels of the partition wall system to vertical studs utilized in the construction thereof.

It is another, even more specific and important object of the invention to provide panel members utilized in the movable partition wall system employing an overlapping joint construction, thereby facilitating the completed wall assembly meeting the one hour fire retardant classification rating.

It is another, even further, more specific object of the invention to provide a panel member utilized in movable partition wall systems wherein the individual panels are demountably secured to infrastructure members making up the whole movable partition wall system.

It is another, even more specific and further object of the invention to provide wall panel members having exterior finish surfaces thereon which have been applied at the factory site, and wherein the panels have been factory site prepared for fast, easy erection into interior wall partitions.

Generally, in an exemplary embodiment, the invention is directed to movable partition wall constructions comprising the combination of spaced ceiling and floor support members having spaced intermediate vertical members forming infrastructure adapted to receive first and second panels forming first and second wall surfaces or faces wherein the first panel comprises a gypsum board member having lateral edges employing over- and underlapping joint construction for mating with similar such panels to form a planar surface or face wherein each of the panels has spaced, vertically aligned externally concealed securement means for securement to one of said vertical members. The second panel member comprises a gypsum member having lateral edges employing joint construction as found in said first panel members and being adapted for mating engagement with similarly constructed such members for forming a planar wall surface or face opposed to the wall surface or face formed by said first panel members. The second panel members are provided with intermittently spaced, vertical, support engaging members so that the individual panels may be secured in place by a tight, releaseable friction fit, and wherein the vertical member securement means is secured to the interiorly directed surface of the second panel members so that, upon erection, the first and second panel members form a partition having an air space therebetween having no exteriorly detectable securement means which are visible.

These and other objects of the invention will become apparent from the hereinafter following commentary taken in conjunction with the figures of drawing.

Figure 1:
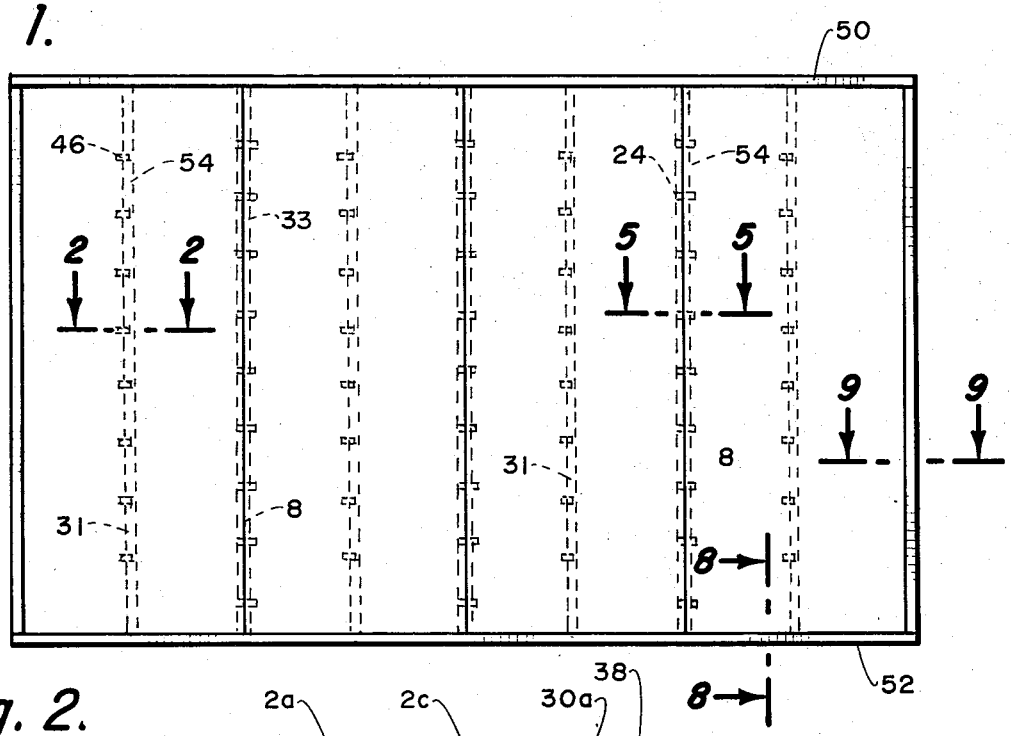
FIG. 1 is a front, elevational view of a movable partition wall in accordance with the herein disclosed invention.

DESCRIPTION OF THE BEST EMBODIMENTS CONTEMPLATED:

Prior to a specific, detailed explanation of the instant movable partition system, a brief summary of the components making up the system would be beneficial for a clearer understanding of the following commentary.

Generally, as is usually the case in movable partition walls, a framework or infrastructure employing ceiling or head runners or tracks and floor or base runners or tracks is utilized along and between which steel C-studs are secured to the top and bottom of the runners or tracks which may be U- or channel-shaped. The panels secured to this support framing form a hollow wall having first and second exterior faces with an air space between the faces.

Individual panels are manufactured on a factory site and shipped to a job site for installation and, typically, may be four feet by nine feet of a five-eighths inch thick, type X, gypsum wallboard modified in accordance with the practice of the invention, as will become apparent. In some instances a vinyl layer may be bonded or applied to the exterior face of each panel and the lateral edges of the panels are modified so as to form steel overlapped joints which interlock in butting relationship the lateral edges of the panels. A layer of commercial fire retardant chipboard paper is bonded to one side of the panel (the surface not having the finished surface, as, for example, the vinyl layer bonded thereto) and the fire retardant chipboard paper may be secured as by means of adhesive or, for example, commercial wheat paste.

The panels are fastened to the light gauge steel frame structure using screws and/or metal clips, as will become apparent as the description proceeds. Because the partition wall system is demountable and has no exposed fasteners, the means of securing the individual panels to the support structure and, more particularly, the C-shaped studs located at the midpoint of each panel is different for the two panel faces forming the partition wall. The first wall, or panel face, to be mounted is secured to intermediate metal studs which are approximately one foot on center by means of Chicago screw posts and secured to the joint studs using steel clips which are also spaced one foot on center. The steel clips are also fastened to the individual panels with, for example, flat head screws, as will be seen hereinafter. The second wall face is secured to the intermediate studs with interlocking steel clips, which clips are one foot on center and become engaged to the C stud flange in order to secure same to the support structure. The steel clips are secured to the gypsum board panels with Chicago screw posts, as will become apparent. The panel joints are secured to the studs in the same manner previously described for the first wall face in the partition wall system.

The infrastructure, or framework of the partition wall system, is constructed of, for example, 0.019 inch thick galvanized steel C studs connected to a top and bottom U channel of 0.020 inch thick galvanized steel. The C studs are, for example, 1.38 inch × 2.5 inch × 8 feet 11 inches and the U channel measures 1.3 inch × 2.55 inch × 12 feet. The studs have a one-half inch space at the top and bottom of the partition to allow for thermal expansion of the framework. Conventional fastening means, such as, for example, flat head Phillips screws, may be used to connect the studs and U channel.

The foregoing is a generic, basic outline of the movable wall partition system of this invention and the specific particulars, including the various details of construction, will now be delved into in conjunction with the figures of drawings wherein like numerals of reference throughout designate like elements. It should be understood that, while the description will be specific as to the invention illustrated in each of the figures of drawings, that the specific description is to be taken as illustrative only and not as delimiting of the invention, inasmuch as various changes, modifications and alternatives will at once make themselves apparent to those of ordinary skill in the art, and all such changes, modifications and alterations will not depart from the spirit and scope of the invention as disclosed and claimed herein.

Figure 3:
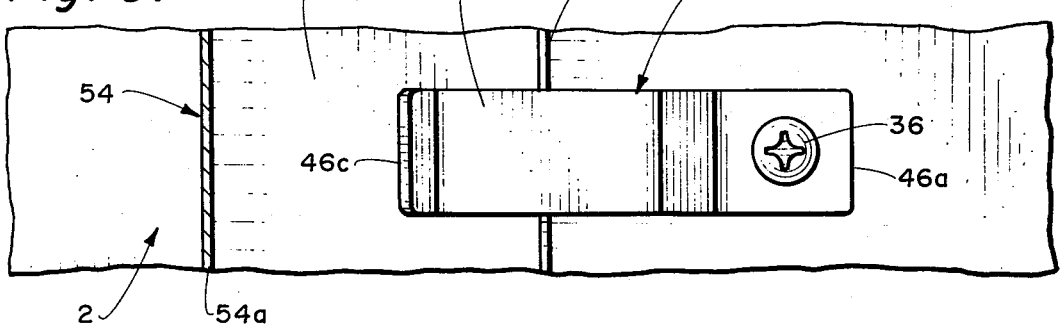
FIG. 3 is a view taken along the line 3—3 of FIG. 2.

Prior to detailing the partition wall system of the invention, it should be understood that each of the panels making up the movable partition are factory-site modified for utilization in the system. For example, a typical five-eighths inch, type X gypsum wallboard panel 2 (FIG. 3) has provided to one surface 4 a 0.038–0.04 inch thick 50 pound density commercial fire retardant chipboard paper backing 6 by means of adhesive or commercially available wheat paste not shown. The long side lateral edges 8 of each of the panels 2 are notched and slotted along the lateral edges 8 so as to form an elongate slot 10 and a notch 12. An L-shaped wood strip 14 is secured to a steel plate 16 or flange approximately 0.062 inch thick × 1.250 inch wide by means of adhesive layer 18.

Figure 5:
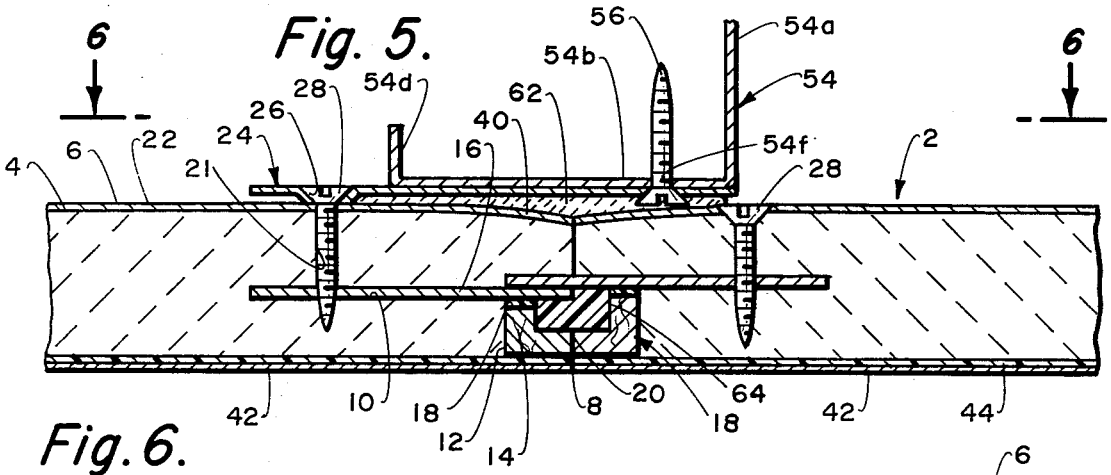
FIG. 5 is an enlarged, fragmented view taken along the line 5—5 of FIG. 1 and illustrating the mating joints of the panels utilized in forming the first and second faces or wall surfaces of the movable partition wall system of the invention.
Figure 6:
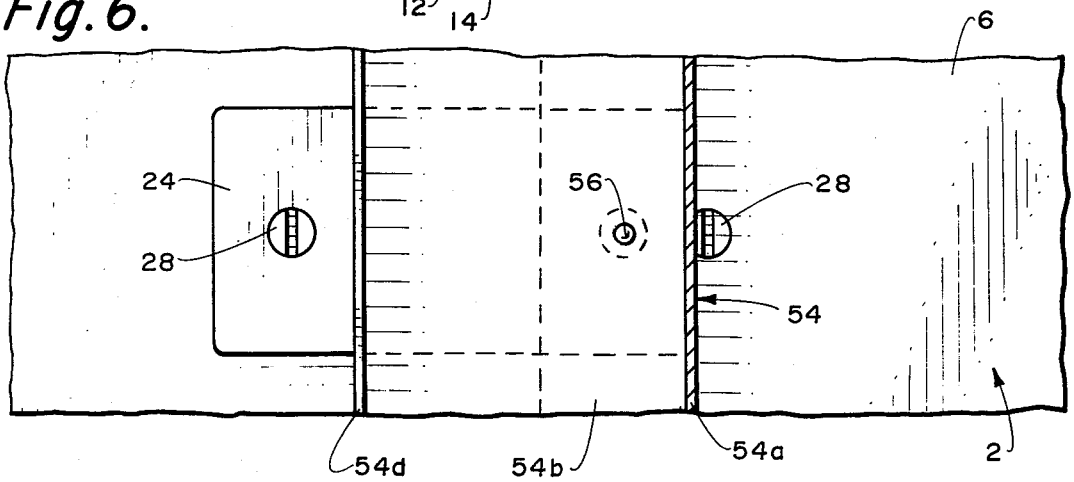
FIG. 6 is a view taken along the line 6—6 of FIG. 5.
Figure 4:
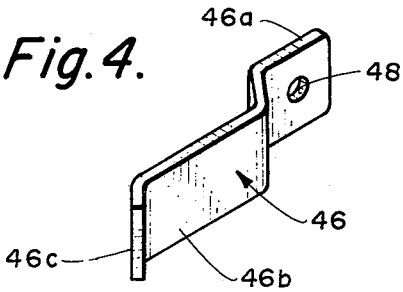
FIG. 4 is a perspective view of the clip member shown in FIGS. 2 and 3.
Figure 7:
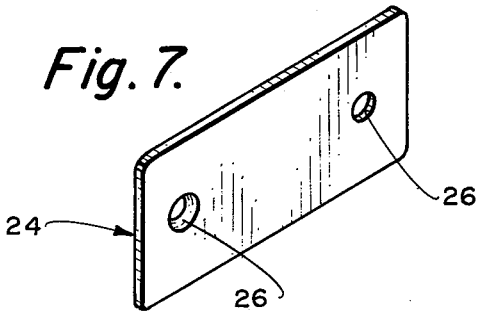
FIG. 7 is a perspective view of a clip member utilized at the joint illustrated in FIG. 5.
Figure 8:
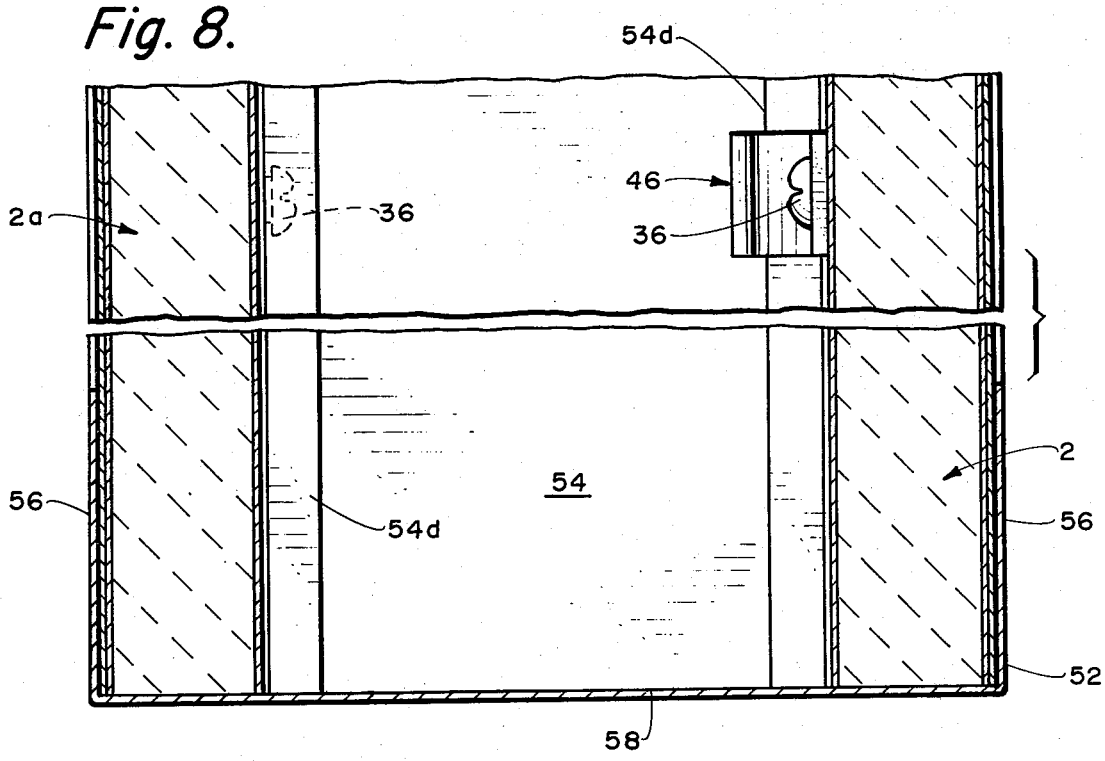
FIG. 8 is an enlarged, fragmented view taken along the line 8—8 of FIG. 1 showing more details of construction of the herein disclosed invention.
Figure 9:
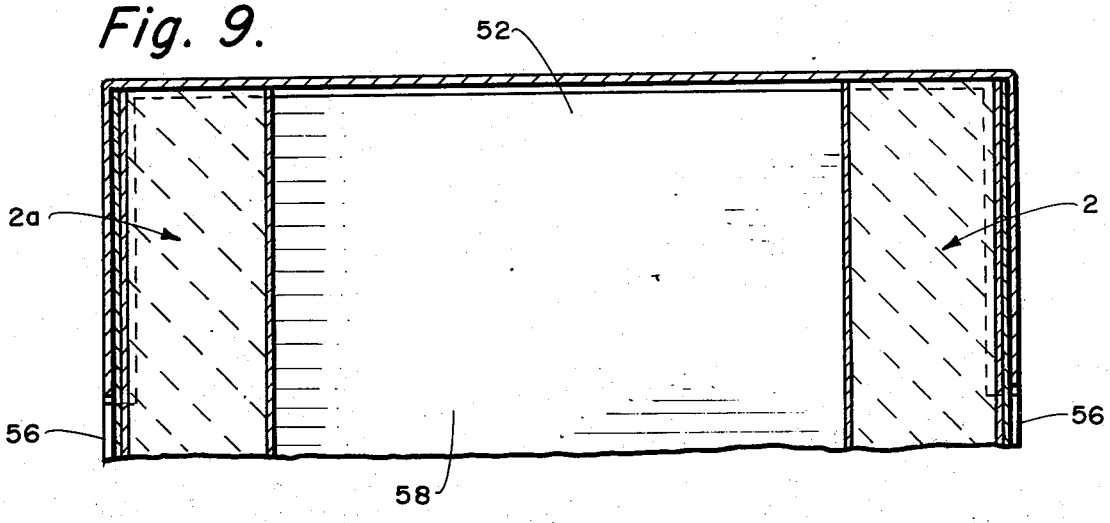
FIG. 9 is an enlarged, fragmented view taken along the line 9—9 of FIG. 1.

The combination wood strip and plate component is then received within the elongate groove 10 and notch 12 as illustrated in the drawings (FIG. 5). If desired, adhesive or glue may be positioned in the groove 10 and notch 12 prior to the wood strip and flange or joint assembly 18 being inserted in the receiving groove and notch as indicated.

The L-shaped wood strip 14 of assembly 18 and, in particular, the edge surface 20 is slightly higher than the plane of the lateral edge 8 by about 0.0010 to 0.0012 of an inch for purposes that will become clear as the description proceeds. The individual panel 2 has a plurality of holes or bores 21 provided from the back surface or side 22 of panel 2 with the inward spacing being approximately 24 inches from lateral edge 8 and being approximately 12 inches on vertical center to accommodate clip member 24, which is provided with two through holes 26 and comprises a steel clip approximately 0.062 inch thick with a two inch length and a one inch height. The through bores 20 may be drilled to appropriate depth to intersect the metal flange or plate 16 of wood and flange assembly 18, as illustrated in FIG. 5 or, alternately, metal pins may be shot through the clip 24 to penetrate the core of panel 2 and penetrate the plate or flange 16 of assembly 18. However, the Phillips Screws 28 as shown will illustrate the concept involved.

The clips 24 are of metal construction approximately 0.062 inch thick, one inch wide and two inches long, so as to overlap abutting joints of panels 2 placed in side by side relationship, as illustrated in FIG. 5. Where pins are used instead of Phillips Screws, the pins are provided with an enlarged head so as to adequately retain the plate 24 through the back side of panel 2. The clip 24 is rotatable so as not to extend beyond the lateral edge 8 when the panel 2 is in transit. At the job site the clip 24 is rotated so as to extend beyond the lateral edge 8 for the installation procedures, as will become apparent hereinafter. The clips 24 are secured approximately 12 inches on center along the long edges 8 of panels 2.

Figure 2:
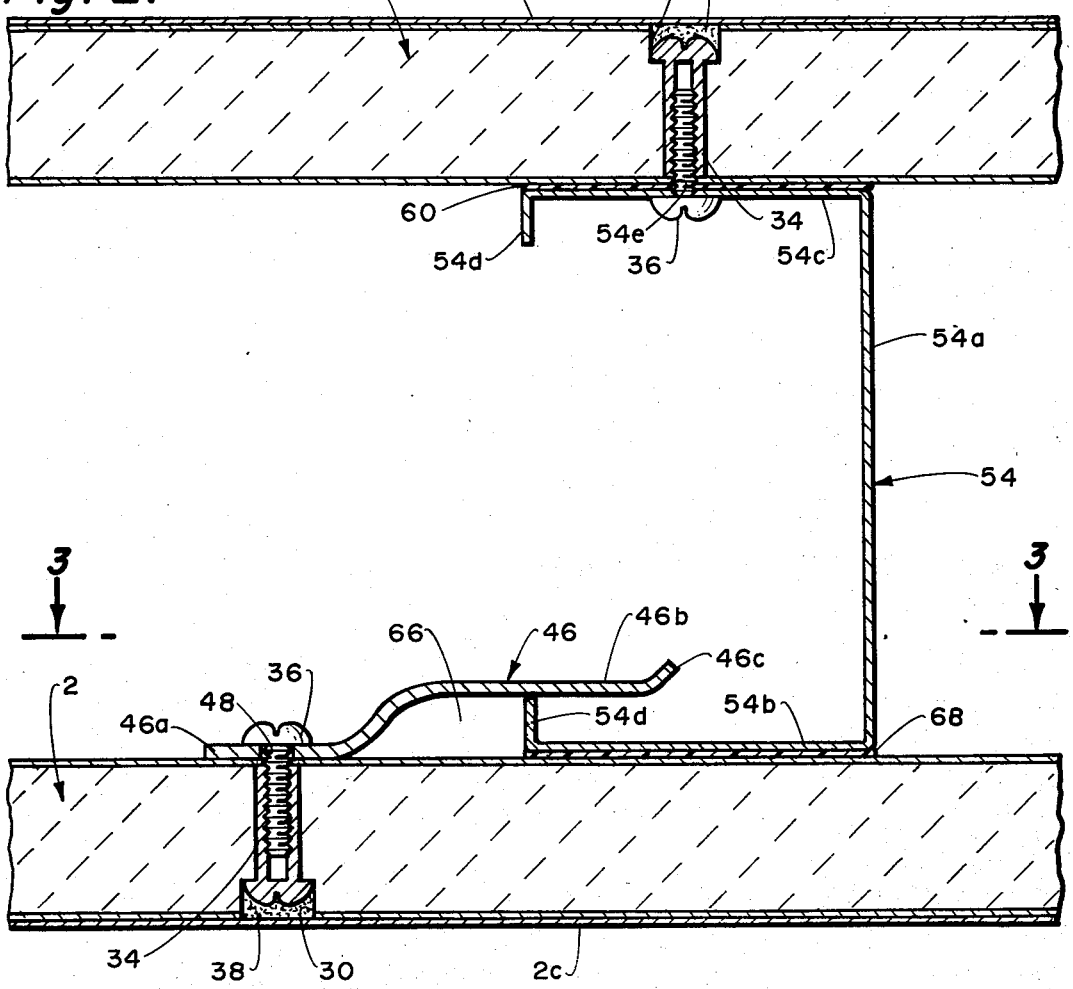
FIG. 2 is an enlarged, fragmented view taken along the line 2—2 of FIG. 1 to illustrate the means of securement of said panels to vertical members forming part of the infrastructure of the movable partition wall system of the invention.

Referring to FIG. 2, additional details of construction for panel 2, comprising one surface of a wall or partition and the opposed panel 2*a* comprising the other panel or surface of a partition or wall are shown. With regard to panel 2, a plurality of Chicago screw posts are provided in the plurality of countersunk holes 30 spaced approximately midpoint of the panel 2 with approximately 12-inch on center spacing along the juncture line 31 (FIG. 1) so as to be spaced and offset from, but intermediate of, the clips 24 spaced along the edge 8 of panel 2, forming juncture line 33 (FIG. 1).

Similarly, the gypsum panels 2*a* are provided with through bores 30*a* which, in spacing, are slightly offset from the through bores 30 provided in the gypsum panel 2 (FIG. 2). The reason for bore 30*a* being offset from the bore 30 is to facilitate the coaction of supporting vertical stud members and friction clips, as will be described as the description proceeds. Suffice to say that each of the bores 30 and 30*a* of panels 2 and 2*a*, respectively, receive the female portions 34 of the Chicago screw-post assembly so as to, at a later stage and during erection of the movable partition system of the invention, receive the male screws or component 36 of the Chicago screw-post type fastener. The countersunk portions of bores 30 and 30*a* are filled with spackle or other filling material 38 so as to provide a planar surface with the remainder of the gypsum board panels 2 and 2*a*, respectively.

After the panels 2 and 2*a* have been prepared as heretofore described, the planar surface 4 in the adjacent area of the lateral edge 8, and more specifically as at 40 (FIG. 5), is slightly tapered as by means of sanding or the like, at which time the front surface 2*c* is sanded in order to insure that the surfaces 2*c* of panels 2 and 2*a* are perfectly planar. Thereafter, a laminate layer 42 is applied to the external face 2*c* of the panels by means of an adhesive or glue layer 44. Each of the panels 2 and 2*a* are then put through a sizing machine and trimmed with a cutter so that the wood portion, or strip 14, of the wood flange assembly 18 is made perfectly square, after which the respective clips 24 are placed in position by means of screws 28, and the friction retaining clips 46 are positioned by means of the Chicago screw-post fastener illustrated in FIG. 2 of the drawings, with the aperture 48 of the clip being provided so as to receive the male fastener portion 36. Referring now in specific reference to all of the drawings, the mode of installation of the movable partition system of the invention will now be described. As has been indicated hereinbefore, the panels 2 and 2*a* have been prefabricated at the factory and shipped to the on-job site for erection and installation of same. As is conventional, the infrastructure comprising vertical support members of lightweight steel, and having a C-stud configuration, are utilized in conjunction with ceiling and floor runners, tracks or headers. More specifically, upper tracks 50 are placed in spaced, opposed relationship on the ceiling of a room, or the like, having corresponding floor or base runners or tracks 52 and intermediate C-studs 54 supported therefrom by means of bolts, fasteners or other means of providing a secure, rigid support structure or infrastructure for receiving the panels of this invention.

In one instance the headers or tracks may take the form of a U-shaped channel-like member having upstanding portions 56 with intermediate web portion 58 secured to the floor by well known means, not shown. In some instances an intermediate channel or flange may be positioned along the web 58 spaced from each of the upstanding edge portions 56 to thereby form an enclosed receiving track (not shown) for the individual panels 2 and 2*a* of the invention.

Spaced approximately 2 feet on center are the metal studs 54, having a top and bottom portion not shown, for adequate securement to the ceiling and base headers or tracks. The metal C-stud 54 is rectangular-like in configuration, having a first web portion 54*a* which would correspond in width to the web space between the panels 2 and 2*a*, having opposed integral wall sections 54*b* and 54*c* with each of the planar portions terminating in right angled lips 54*d*, the stud 54 extending the height or distance between upper track 50 and lower track 52. Wall portion 54*c* is provided with through bores 54*e*, spaced approximately 2 feet apart, in order to receive the male portion 36 of Chicago screw-post fastener, as will become apparent. The studs 54 are positioned along the juncture line 31 and along the juncture line 33 and, referring to FIG. 5, it will be noted that the C-stud 54, more particularly the wall portion 54*b*, is provided with an aperture 54*f* spaced so as to receive Phillips Screw 56 or other fastener in secure relationship therewith.

Once the support structure comprising the tracks and C-studs has been erected, the panels 2 and 2*a* of the invention are then ready for installation. Referring to FIG. 2, the panels 2*a* comprising the first face are prepared for installation and it is this first face that is installed entirely so as to leave the partition wall structure open for installation of the second face comprising the plurality of panels 2. An adhesive matrix or caulk adhesive 60 is applied to the exterior of the wall portion 54*c* of C-stud 54 and the panel 2*a* secured by means of male component 36 being screwed into female portion 34 of Chicago screw-post fastener along the juncture line 31, as illustrated in FIG. 2. At the juncture line 33 comprising the butt joint, an adhesive or caulking layer 62 is provided and the one panel erected, as shown to the left of FIG. 5, by means of Phillips Screw 56 secured to C-stud 54, and the second panel is put in abutting relationship along the lateral edges 8 after a quantity of the adhesive or caulking compound 64 has been applied along the lateral edges 8 of the panels 2 and 2*a*, as illustrated in FIG. 5, substantially filling the groove or recess formed by the mating of the L-shaped wood components or strips 14 comprising the wood and flange assembly 18. It will be noted that the metal flanges comprising the assembly 18 overlap so as to form an overlapped butt joint, best illustrated in FIG. 5.

After the first face or wall has been erected, the second face or surface is ready for erection and, more specifically, to form the dual partition wall structure as seen in FIG. 2. As indicated, the friction clips 46 have been secured in place, which friction clips have a first flat portion 46*a* for retention to the inner planar surface of the panel 2 with an offset spring portion 46*b* terminating in upwardly extending lip 46*c*, so that the clip 46 provides, with the planar surface of the panel 2, a receiving channel or path 66 for receiving, in friction fit retentive relationship, the edge or lip portion 54*d* of C-stud 54. Along these lines, therefore, the C-stud 54, along the juncture line 31, is provided with a layer of adhesive or caulking compound 68 and the panel placed thereagainst and positioned so that the spring clip 46 frictionally engages the end portion 54*d* of C-stud 54. The joint portion of panels 2, forming the second face of the partition wall of the inventive system, is as previously described with regard to the formation of the first face of the formed wall of the movable partition system hereinbefore described.

Figure 10:
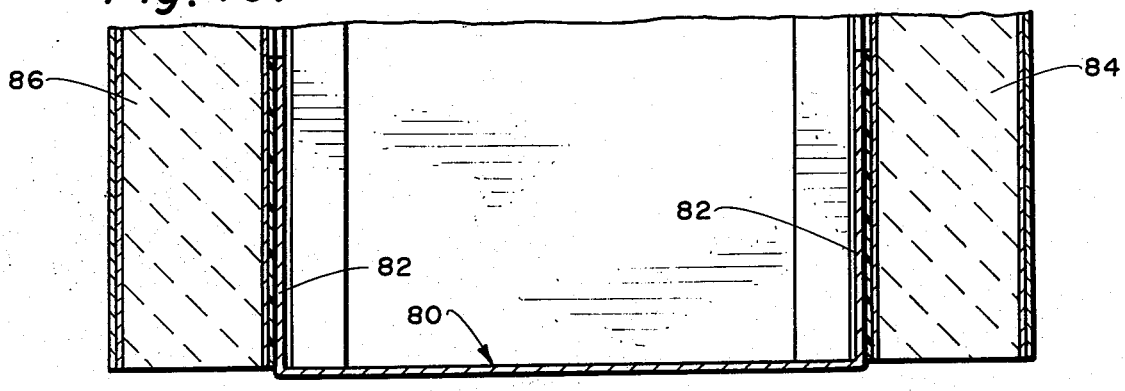
FIG. 10 is an enlarged, fragmented view of an alternative embodiment of the invention illustrating the aspects thereof.

Referring to FIG. 10, a different type of base track and, therefore, ceiling track or support is illustrated wherein the support 80 is in the form of a smaller U section, having upstanding side portions 82 so as to receive the panels 84 and 86 on the outside thereof as opposed to being received interiorly as previously described. In each instance the panels 84 and 86 making up the first surface and second surface, respectively, of the movable wall partition system remain the same as previously described for the panels 2 and 2*a*.

There has thus been described a partition system which is movable and demountable in character, not requiring cavity boards as in prior art systems, and which is erectable in a much shorter period of time than the prior art structures, and which provides a one hour fire test rating structure for utilization in offices, homes and other environs which the prior art has not heretofore been able to provide.

I claim:

1. Movable partition wall construction comprising the combination: spaced horizontal ceiling and floor support members having spaced intermediate vertical support members forming infrastructure adapted to receive first and second panels forming spaced first and second exterior wall surfaces, respectively, said first panel comprising a gypsum board member having a first and second lateral edges adapted to coact with like first panels in abutting relationship to form over- and underlapping joint construction, and having vertically aligned, externally concealed securement means spaced from said first and second lateral edges for dismountable securement to one of said vertical members adjacent thereto; said second panel member comprising a gypsum board member similar in construction to said first panel and additionally including spaced spring clip means adapted to cooperatively engage an adjacently positioned vertical member in retained and releaseable fashion, said lateral edges of said first and second panels having a recessed notched portion extending the length thereof, said recessed notched portion having a communicating slot substantially coextensive therewith.

2. The movable partition wall construction in accordance with claim 1 wherein said first and second panels additionally include an L-shaped elongated joint member having an extending flange portion disposed in said recessed notch portion with one end of said extending flange extending into said communicating slot.

3. The movable partition wall construction in accordance with claim 3 wherein one of the L-shaped, elongated joint members has an extending flange portion to thereby form said over- and underlapping joint construction.

4. The movable partition wall construction in accordance with claim 3 wherein said flange members are metal and are intermittently secured to said panels by metallic securement means.

5. The movable partition wall construction in accordance with claim 4 wherein said elongated, L-shaped joint member is of cellulose fiber material adhesively secured to said metallic flange member.

6. The movable partition wall construction in accordance with claim 4 wherein said first and second panels are of gypsum core construction.

7. The movable partition wall construction in accordance with claim 6 wherein said vertically aligned externally concealed securement means comprise intermittently spaced threaded female fasteners adapted to receive male screw portions in threaded relationship.

8. The movable partition wall construction in accordance with claim 7 wherein said threaded female fastening component of said securement member is spaced intermediate said lateral edges on the panel surface interior of said intermediate vertical support members.

9. The movable partition wall construction in accordance with claim 8 wherein along at least one lateral edge of said first and second panels a clip member is secured to the inner surface thereof in order to provide an over the butt joint extending portion adapted to be secured to said spaced intermediate vertical support members.

10. The movable partition wall construction in accordance with claim 9 wherein said spaced intermediate vertical support members have a C configuration in cross section having spaced apertures for receiving said male threaded bolts intermediate said lateral edges and adjacent said butt seams.

11. The movable partition wall construction in accordance with claim 10 wherein said spaced intermediate vertical support members are positioned adjacent said abutting panels and intermediate the lateral edges of same.

12. The movable partition wall construction in accordance with claim 11 wherein an adhesive is positioned between the spaced intermediate vertical support members and said panels secured thereto.

13. The movable partition wall construction in accordance with claim 12 wherein adhesive is positioned within the under and overlapping joint construction formed by said panels being in abutting relationship.

14. The movable partition wall construction in accordance with claim 13 including a fire retardant fiber layer on the inside surfaces of said panels adjacent said spaced intermediate vertical support members.

15. The movable partition wall construction in accordance with claim 14 including a decorative material layer on the exterior surface of said panels forming the first and second wall surfaces of said movable partition wall.

16. The movable partition wall construction in accordance with claim 15 wherein said C-shaped intermediate vertical support members have an extending lip portion, one of which cooperates with said spaced spring clip means to cooperatively and frictionally engage said vertical support member wherein said spring clip means has a configuration adapted for frictional secure engagement with said lip of said spaced intermediate vertical support members positioned adjacently thereto.

17. The movable partition wall construction in accordance with claim 16 wherein said securement means intermittently spaced to secure said flanges are screws.

18. The movable partition wall construction in accordance with claim 16 wherein said securement means securing said flanges are metal pins.

19. The movable partition wall construction in accordance with claim 16 wherein the said spaced horizontal ceiling and floor support members and said spaced intermediate vertical support members are of metal.

20. The movable partition wall construction in accordance with claim 19 wherein said panels supported on said infrastructure form at least a one hour fire rated partition wall.

* * * * *